US012578119B2

(12) United States Patent
Jeon et al.

(10) Patent No.: US 12,578,119 B2
(45) Date of Patent: Mar. 17, 2026

(54) HOT WATER SUPPLY TANK

(71) Applicant: LG ELECTRONICS INC., Seoul (KR)

(72) Inventors: Bonggil Jeon, Seoul (KR); Doyong Ha, Seoul (KR); Jeongseob Shin, Seoul (KR); Heewoong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 110 days.

(21) Appl. No.: 18/280,538

(22) PCT Filed: Mar. 7, 2022

(86) PCT No.: PCT/KR2022/003143

§ 371 (c)(1),
(2) Date: Sep. 6, 2023

(87) PCT Pub. No.: WO2022/191534

PCT Pub. Date: Sep. 15, 2022

(65) Prior Publication Data

US 2024/0151431 A1 May 9, 2024

(30) Foreign Application Priority Data

Mar. 10, 2021 (KR) ..... 10-2021-0031498

(51) Int. Cl.
*F24H 1/18* (2022.01)
*F24D 3/08* (2006.01)
(Continued)

(52) U.S. Cl.
CPC ..... *F24H 1/181* (2013.01); *F24D 3/082* (2013.01); *F24D 3/18* (2013.01); *F24D 17/02* (2013.01);
(Continued)

(58) Field of Classification Search
CPC ..... F28D 20/0039; F28D 2020/0073; F24H 1/181
See application file for complete search history.

(56) References Cited

U.S. PATENT DOCUMENTS

RE30,540 E * 3/1981 Lyon ..... F24D 11/003 165/104.31
4,399,656 A * 8/1983 Laing ..... F01K 3/00 376/322
(Continued)

FOREIGN PATENT DOCUMENTS

JP S61-159092 7/1986
JP S62-233689 10/1987
(Continued)

OTHER PUBLICATIONS

International Search Report dated Jul. 7, 2022 issued in Application No. PCT/KR2022/003143.
(Continued)

*Primary Examiner* — Christopher R Zerphey
(74) *Attorney, Agent, or Firm* — KED & ASSOCIATES, LLP

(57) ABSTRACT

The present invention relates to a hot water supply tank. A hot water supply tank, according to an embodiment of the present invention, comprises: a storage part which accommodates a fluid therein; an internal water outlet pipe through which a fluid flows from the storage part toward a heat pump; an internal water supply pipe through which the fluid flows from the heat pump toward the storage part; and an internal pipe which is disposed inside the storage part, wherein the internal pipe includes: a connection pipe which is connected to the internal water supply pipe, and at least a part of which is flexible; and a discharge pipe which has one end connected to the connection pipe and extending long, wherein a pipe through hole passing through the discharge
(Continued)

pipe may be formed at the other end of the discharge pipe. Various other embodiments are possible.

4 Claims, 14 Drawing Sheets

(51) Int. Cl.

| | |
|---|---|
| ***F24D 3/18*** | (2006.01) |
| ***F24D 17/02*** | (2006.01) |
| ***F24H 4/04*** | (2006.01) |
| ***F24H 9/13*** | (2022.01) |
| ***F28D 20/00*** | (2006.01) |

(52) U.S. Cl.
CPC ..... *F24H 4/04* (2013.01); *F24H 9/133* (2022.01); *F28D 20/0039* (2013.01); *F24D 2200/123* (2013.01); *F24D 2220/08* (2013.01); *F28D 2020/0069* (2013.01); *F28D 2020/0073* (2013.01)

(56) References Cited

U.S. PATENT DOCUMENTS

| | | | | |
|---|---|---|---|---|
| 4,420,032 | A * | 12/1983 | Van Koppen | F24D 11/003 126/400 |
| 6,835,307 | B2 | 12/2004 | Talbert et al. | |
| 10,012,449 | B2 * | 7/2018 | Spanggaard | F28D 20/0039 |
| 11,415,340 | B2 * | 8/2022 | Zhang | F24H 1/181 |
| 2011/0094706 | A1 | 4/2011 | Ramani | |
| 2016/0195339 | A1 * | 7/2016 | Simon | F28D 20/0039 165/104.19 |

FOREIGN PATENT DOCUMENTS

| | | |
|---|---|---|
| JP | 07-012405 | 1/1995 |
| JP | 2005-180789 | 7/2005 |
| WO | WO 2014/106643 | 7/2014 |

OTHER PUBLICATIONS

Korean Office Action dated Nov. 14, 2025 issued in Application No. 10-2021-0031498.

* cited by examiner

HOT WATER SUPPLY TANK

CROSS-REFERENCE TO RELATED PATENT APPLICATIONS

This application is a U.S. National Stage Application under 35 U.S.C. § 371 of PCT Application No. PCT/KR2022/003143, filed Mar. 7, 2022, which claims priority to Korean Patent Application No. 10-2021-0031498, filed Mar. 10, 2021, whose entire disclosures are hereby incorporated by reference.

TECHNICAL FIELD

The present disclosure relates to a hot water supply tank, and more particularly, to a hot water supply tank capable of maintaining thermal stratification of water stored therein.

BACKGROUND ART

In general, a hot water supply apparatus uses a heating source to heat water to provide a user with hot water. Here, an apparatus that provides a user with hot water heated by a heat pump may be referred to as a hot water supply apparatus associated with a heat pump.

Such a hot water supply apparatus may include a hot water supply tank for storing hot water to be provided to a user. For example, the hot water supply tank may include a storage part for storing water therein, a water supply passage through which water flows from the outside to the storage part, and a water discharge passage through which hot water to be provided to a user flows.

Meanwhile, the density of water may change with temperature. Due to density differences of water, relatively low-temperature water may be located at the bottom of the storage part and relatively high-temperature water may be located at the top of the storage part. In this case, stratification, which is the phenomenon in which water stored in the storage part of the hot water supply tank forms (thermal) layers with fixed positions due to differences in density, may occur, and this phenomenon is also referred to as thermal stratification.

Thermal stratification in the hot water supply tank serves to improve the energy quality of hot water. In order to preserve the energy quality of the hot water, it is necessary to prevent the collapse of thermal stratification caused by relatively low-temperature water flowing into the top of the hot water supply tank or relatively high-temperature water flowing into the bottom of the hot water supply tank.

In the related art, a temperature sensor for sensing the temperature of water heated by a heat pump and a valve for changing a flow direction of water supplied to a hot water supply tank are used to supply water to the top of the hot water supply tank when the temperature of water is high, and to supply water to the bottom of the hot water supply tank when the temperature of water is low. However, when a sensor, a valve, and the like are additionally provided, price competitiveness may be reduced. In addition, the collapse of thermal stratification may not be prevented when a malfunction of the sensor, the valve, or the like occurs.

DISCLOSURE OF INVENTION

Technical Problem

It is an objective of the present disclosure to solve the above and other problems.

It is another objective of the present disclosure to provide a hot water supply tank having a configuration that can prevent the collapse of thermal stratification of water stored in a storage part.

The objectives of the present disclosure are not limited to the objectives described above, and other objectives not stated herein will be clearly understood by those skilled in the art from the following description.

Technical Solution

According to one aspect of the subject matter described in this application, a hot water supply tank may include: a storage part in which a fluid is stored; an internal water outlet pipe through which the fluid flows from the storage part to a heat pump; an internal water inlet pipe through which the fluid flows from the heat pump to the storage part; and an internal pipe disposed in the storage part. The internal pipe may include: a connection pipe connected to the internal water inlet pipe and having at least a portion being flexible; and a discharge pipe having one end connected to the connection pipe to extend in an elongated manner. At least one pipe through-hole formed through the discharge pipe may be defined at another end of the discharge pipe.

The pipe through-hole may be formed at a lateral portion of the another end of the discharge pipe facing a horizontal direction of the storage part.

At least a portion of the connection pipe may be bent multiple times along an extension direction to have a corrugated shape.

A maximum horizontal length of the internal pipe may be less than a diameter of the storage part.

A specific gravity of the discharge pipe may correspond to a specific gravity of the fluid at a predetermined temperature.

The internal pipe may be connected to the internal water inlet pipe at a portion corresponding to a middle of a vertical height of the storage part.

According to another aspect of the subject matter described in this application, a hot water supply tank may include: a storage part in which a fluid is stored; an internal water outlet pipe through which the fluid flows from the storage part to a heat pump; an internal water inlet pipe through which the fluid flows from the heat pump to the storage part; and a buffer including a lateral wall elongated in a vertical direction in the storage part. A buffer space surrounded at least by an inner circumferential surface of the lateral wall and an inner space of the storage part may be disconnected from each other in a horizontal direction by the lateral wall. The internal water inlet pipe and the buffer space may be in communication with each other, so as to allow the fluid flowing in the internal water inlet pipe to be introduced into the buffer space.

The buffer may include at least one of an upper cover connected to an upper end portion of the lateral wall to cover a top of the buffer space and a lower cover connected to a lower end portion of the lateral wall to cover a bottom of the buffer space.

The upper cover may have at least one upper through-hole formed therethrough. The lower cover may have at least one lower through-hole formed therethrough.

The lateral wall may have a lateral wall through-hole formed therethrough and through which the internal water inlet pipe and the buffer space communicate with each other. A total sum of an area of the at least one upper through-hole may be greater than or equal to an area of the lateral wall through-hole. A total sum of an area of the at least one lower through-hole may be greater than or equal to the area of the lateral wall through-hole.

The lateral wall through-hole may be formed at a portion corresponding to a middle of a vertical height of the lateral wall.

The buffer may further include a swirl induction pipe having one end connected to the internal water inlet pipe and extending along the inner circumferential surface of the lateral wall.

The swirl induction pipe may extend parallel to a horizontal direction of the lateral wall.

An extension direction of the internal water inlet pipe may correspond to a tangential direction of the inner circumferential surface of the lateral wall.

Details of other embodiments are included in the detailed description and the accompanying drawings.

Advantageous Effects

According to various embodiments of the present disclosure, a specific gravity of an internal pipe for discharging water into a storage part may change in response to the temperature of water supplied to a hot water supply tank, and a position of the internal pipe may be properly changed in response to a change in the specific gravity of the internal pipe, thereby minimizing the collapse of thermal stratification of water stored in the storage part.

In addition, according to various embodiments of the present disclosure, as part of water supplied to a hot water supply tank and part of water stored in a storage part are configured to be primarily mixed in a buffer space disposed in the storage part, the collapse of thermal stratification of the water stored in the storage part may be minimized.

The effects of the present disclosure are not limited to the effects described above, and other effects not mentioned will be clearly understood by those skilled in the art from the claims.

MODE FOR INVENTION

Figure 1:
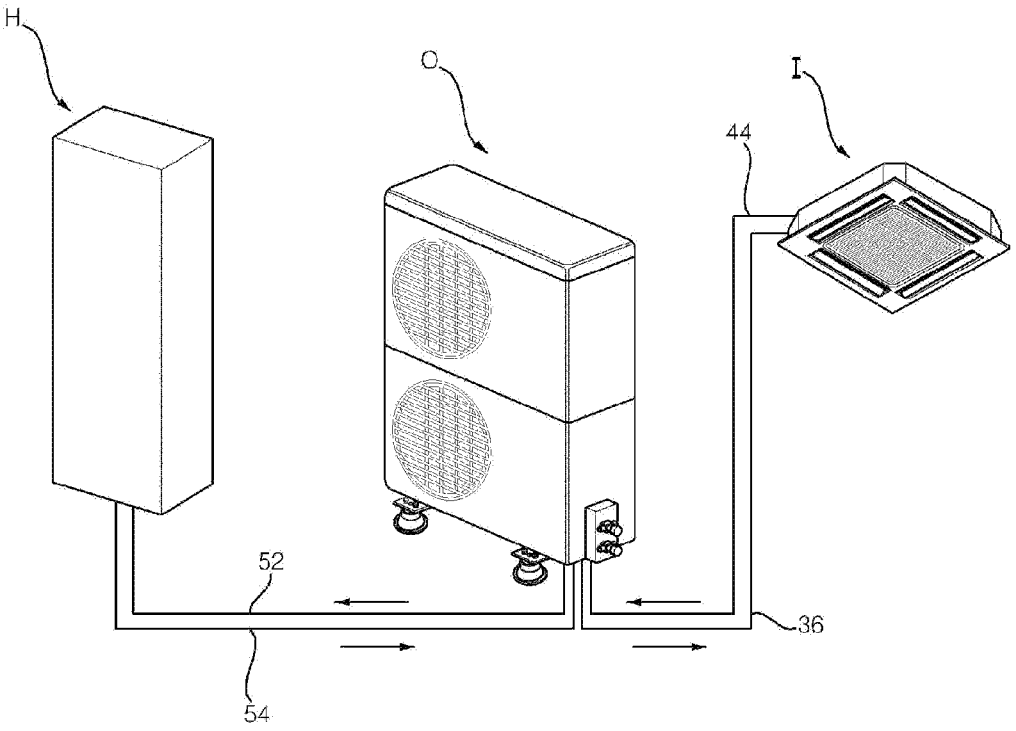
FIG. 1 is a schematic diagram of a heat pump according to an embodiment of the present disclosure.

The above and other aspects, features and other advantages of the present disclosure will be more clearly understood from the following detailed description taken in conjunction with the accompanying drawings. Exemplary embodiments will now be described more fully hereinafter with reference to the accompanying drawings; however, they may be embodied in many different forms and should not be construed as limited to the embodiments set forth herein. Rather, these embodiments are provided so that this disclosure will be thorough and complete, and will fully convey the scope of the exemplary embodiments to those skilled in the art. The same reference numerals are used throughout the drawings to designate the same or similar components.

Spatially relative terms, such as, "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated at other orientations) and the spatially relative terms used herein interpreted accordingly.

The terminology used herein is for the purpose of describing particular embodiments only and is not intended to limit the full scope of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated components, steps, and/or operations, but do not preclude the presence or addition of one or more other components, steps, and/or operations.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

In the drawings, the thickness or size of each component is exaggerated, omitted, or schematically shown for the sake of convenience and clarity. Also, the size and area of each component do not entirely reflect the actual size or area thereof.

In the following description, a suffix such as "module" and "unit" may be used to refer to elements or components. Use of such a suffix herein is merely intended to facilitate description of the specification, and the suffix itself is not intended to give any special meaning or function.

It will be understood that although the terms first, second, etc. may be used herein to describe various elements, these elements should not be limited by these terms. These terms are only used to distinguish one element from another.

Figure 2:
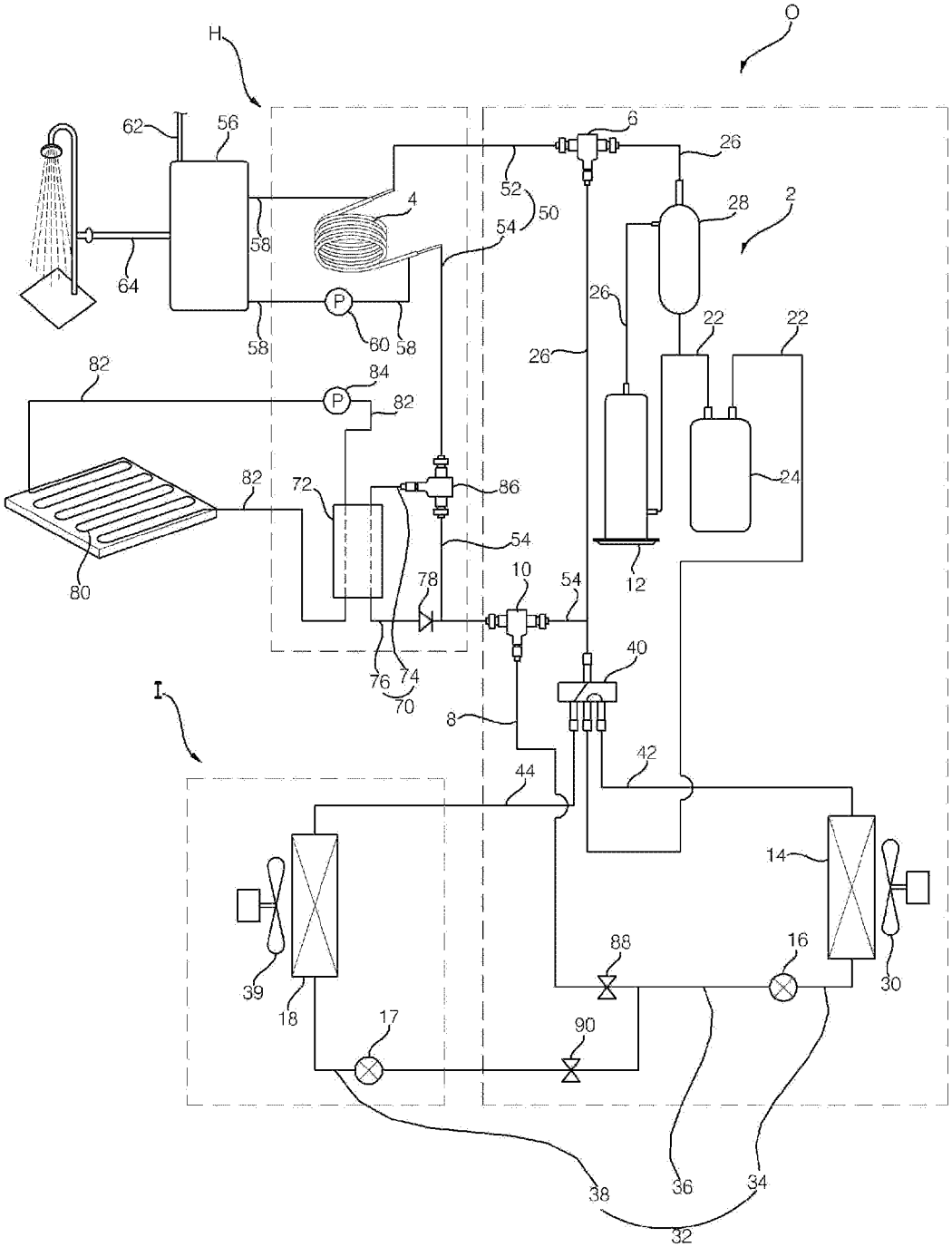
FIG. 2 is a configuration diagram of a system including a heat pump according to an embodiment of the present disclosure.

FIG. 1 is a schematic diagram of a heat pump according to an embodiment of the present disclosure, and FIG. 2 is a configuration diagram of a system including the heat pump.

Referring to FIGS. 1 and 2, a heat pump may include an outdoor unit O, an indoor unit I, and/or a hot water supply unit H.

The outdoor unit O may include a compressor 12 for compressing refrigerant, an accumulator 24 provided on an intake flow path 22 of the compressor 12 to prevent liquid refrigerant from flowing into the compressor 12, an oil separator 28 provided on a discharge flow path 26 of the compressor 12 to separate oil from refrigerant discharged from the compressor 12 and to recover the separated oil to the compressor 12, a cooling/heating switching valve 40 for selecting a flow path of refrigerant according to the heating/cooling operation, and the like. In addition, the outdoor unit O may further include a plurality of sensors, valves, and the like.

The outdoor unit O and the indoor unit I may each include a heat exchanger (14, 18), a fan (30, 39), and/or an expander (16, 17), and may perform cooling-air conditioning to cool air of an indoor space (or a room) or heating-air conditioning to heat air of the indoor space according to the flow direction of refrigerant. For example, the indoor unit I may be supplied with compressed refrigerant from the outdoor unit O to discharge cold and hot air to the indoor space.

An outdoor heat exchanger 14 may condense or evaporate refrigerant. The outdoor heat exchanger 14 may be configured to exchange heat between outdoor air and refrigerant, and may also be configured to exchange heat between cooling water and refrigerant. For example, when the outdoor heat exchanger 14 is configured as an air-refrigerant heat exchanger, an outdoor fan 30 may be disposed on one side of the outdoor heat exchanger 14 to blow outdoor air to the outdoor heat exchanger 14, thereby facilitating the heat dissipation of refrigerant. Hereinafter, the outdoor heat exchanger 14 being configured as an air-refrigerant heat exchanger where heat exchange takes place between outdoor air and refrigerant will be used as an example for description.

The outdoor heat exchanger 14 may be connected to an indoor heat exchanger 18 through a heat exchanger connection pipe 32, and the expander (16, 17) may be installed on the heat exchanger connection pipe 32. The heat exchanger connection pipe 32 may include an expander connection pipe 36 that connects an outdoor expander 16 and an indoor expander 17, an outdoor heat exchanger-outdoor expander connection pipe 34 that connects the outdoor heat exchanger 14 and the outdoor expander 16, and an indoor expander-indoor heat exchanger connection pipe 36 that connects the indoor heat exchanger 18 and the indoor expander 17.

As for the indoor heat exchanger 18, which is a heat exchanger that exchanges heat between indoor air and refrigerant to cool or heat an indoor space, an indoor fan 39 may be disposed on one side of the indoor heat exchanger 18 to blow indoor air to the indoor heat exchanger 18.

In cooling mode in which the heat pump cools the indoor space through the indoor unit I, refrigerant compressed by the compressor 12 of the outdoor unit O may sequentially pass through the outdoor heat exchanger 14, the expander 16, 17, and the indoor heat exchanger 18, and then be recovered to the compressor 12, allowing the indoor heat exchanger 18 to function as an evaporator. Conversely, in heating mode in which the heat pump heats the indoor space through the indoor unit I, refrigerant compressed by the compressor 12 of the outdoor unit 200 may sequentially pass through the indoor heat exchanger 18, the expander 16, 17, and the outdoor heat exchanger 14, and then be recovered to the compressor 12, allowing the indoor heat exchanger 18 to function as a condenser.

The cooling/heating switching valve 40 may switch a flow direction of refrigerant to allow the refrigerant to flow in the order of the compressor 12, the outdoor heat exchanger 14, the expander 16, 17, and the indoor heat exchanger 18, or in the order of the compressor 12, the indoor heat exchanger 18, the expander 16, 17, and the outdoor heat exchanger 18. The heating/cooling switching valve 40 may be connected to the compressor 12 through the compressor intake flow path 22 and the compressor discharge flow path 26, may be connected to the indoor heat exchanger 18 through an indoor heat exchanger connection pipe 31, and may be connected to the outdoor heat exchanger 14 through an outdoor heat exchanger connection pipe 32.

The outdoor unit O may include a refrigerant control valve 6 that allows refrigerant supplied from the compressor discharge flow path 26 to be selectively supplied to the hot water supply unit H or the cooling/heating switching valve 40. Here, when the refrigerant control valve 6 is configured as a 3-way valve, an inlet port and a first outlet port of the refrigerant control valve 6 may be connected to the compressor discharge flow path 26 and a second outlet port of the refrigerant control valve 6 may be connected to a hot water supply inflow path 52.

Alternatively, the refrigerant control valve 6 may be configured to include a first valve that is provided between the refrigerant control valve 6 and the heating/cooling switching valve 40 of the compressor discharge flow path 26 to be closed during the operation including at least one of a hot water supply operation and a floor heating operation and be opened during an air conditioning operation, and a second valve that is provided on the hot water supply inflow path 52 to be opened during the operation including at least one of a hot water supply operation and a floor heating operation and be closed during an air conditioning operation.

The outdoor unit O may further include a heat exchanger bypass valve 88 that is provided on a heat exchanger bypass flow path 8 to regulate the flow of refrigerant, and a liquid refrigerant valve 90 that is provided between the heat exchanger bypass flow path 8 and the indoor expander 17 to regulate the flow of refrigerant.

The compressor 12, the accumulator 24, the oil separator 28, the outdoor heat exchanger 14, the expander 16, 17, the indoor heat exchanger 18, and the like may constitute a refrigeration cycle circuit 2.

A hot water supply heat exchanger 4 may be connected to a hot water supply flow path 50 so as to allow refrigerant discharged from the compressor 12 to be condensed, expanded, and evaporated in the refrigeration cycle circuit 2 after being used for hot water supply.

The hot water supply flow path 50 may include the hot water supply inflow path 52 through which refrigerant discharged from the compressor 12 flows to the hot water supply heat exchanger 4, and a hot water supply outflow path 54 through which refrigerant discharged from the hot water supply heat exchanger 4 flows to the cooling/heating switching valve 40.

One end of the hot water supply inflow path 52 may be connected to the compressor discharge flow path 26 and another (or opposite) end thereof may be connected to the hot water supply heat exchanger 4.

One end of the hot water supply outflow path 54 may be connected to the hot water supply heat exchanger 4 and another (or opposite) end thereof may be connected to the compressor discharge flow path 26.

The hot water supply heat exchanger 4 may serve as a desuperheater, so that, when refrigerant flows to the hot water supply unit H via the refrigerant control valve 6, overheated or superheated refrigerant from the compressor 12 is condensed while exchanging heat with water used for hot water supply.

The hot water supply heat exchanger 4 may include a refrigerant flow path through which overheated refrigerant passes, and a water flow path through which water used for hot water supply passes.

The hot water supply heat exchanger 4 may be configured as a double pipe heat exchanger in which the refrigerant flow path and the water flow path are respectively provided inside and outside with a heat transfer member interposed therebetween, or a plate-type heat exchanger in which the refrigerant flow path and the water flow path are provided in an alternate manner with a heat transfer member interposed therebetween.

The hot water supply heat exchanger 4 may be connected to a hot water supply tank 56 through a hot water pipe 58. A hot water supply pump 60 may be provided on the hot water pipe 58.

A water inlet 62 through which external water is supplied to the hot water supply tank 56 and a water outlet 64 through which water of the hot water supply tank 56 is discharged may be connected to the hot water supply tank 56.

The hot water supply tank 56 may be configured such that water introduced into the hot water supply tank 56 after being heated in the hot water supply heat exchanger 4 is directly discharged to the water outlet 64.

The heat pump may allow refrigerant that has been used for heating of the hot water supply heat exchanger 4 to bypass to the refrigeration cycle circuit 2 or to flow to the refrigeration cycle circuit 2 after being used for floor heating or air conditioning heating of an indoor space.

The hot water supply unit H may further include a water and refrigerant heat exchanger 72.

The water and refrigerant heat exchanger 72 may be a condensation heat exchanger in which refrigerant primarily condensed in the hot water supply heat exchanger 4 is further condensed while exchanging heat with water.

The water and refrigerant heat exchanger 72 may include a refrigerant flow path through which refrigerant that has passed through the hot water supply heat exchanger 4 passes, and a water flow path through which water used for floor heating or air conditioning heating of an indoor space passes.

The water and refrigerant heat exchanger 72 may be configured as a double pipe heat exchanger in which the refrigerant flow path and the water flow path are respectively provided inside and outside with a heat transfer member interposed therebetween, or a plate-type heat exchanger in which the refrigerant flow path and the water flow path are provided in an alternate manner with a heat transfer member interposed therebetween.

The water and refrigerant heat exchanger 72 may be connected to a heating inflow path 74 through which at least part of refrigerant flowing through the hot water supply outflow path 54 flows, and a heating outflow path 76 through which refrigerant that has passed through the water and refrigerant heat exchanger 72 flows. The heating inflow path 74 and the heating outflow path 76 may constitute a water and refrigerant heat exchanger connection path 70.

The heating outflow path 76 may be provided with a check valve 78 to prevent refrigerant flowing through the hot water supply outflow path 54 from flowing back to the water and refrigerant heat exchanger 72 through the heating outflow path 76.

The water and refrigerant heat exchanger 72 may be connected to a heating water pipe 82 connected to a floor heating pipe 80 installed on the floor of an indoor space.

A floor heating pump 84 may be installed on the heating water pipe 82. Heat of refrigerant that has passed through the hot water supply heat exchanger 4 may be transferred to a fluid flowing by the floor heating pump 84, and the heat transferred to the fluid may be additionally used for floor heating of an indoor space.

When the water and refrigerant heat exchanger 72 is installed in a case and an indoor fan that circulates indoor air to the water and refrigerant heat exchanger 72 is installed in the case, the water and refrigerant heat exchanger 72, the case, and the indoor fan may constitute a fan coil unit that circulates and heats indoor air. Here, heat of refrigerant that has passed through the hot water supply heat exchanger 4 may be additionally used for air conditioning heating of an indoor space.

In the following, for ease of explanation, it will be described that the floor heating pipe 80 is connected to the water and refrigerant heat exchanger 72 through the heating water pipe 82, and the floor heating pump 84 is installed on the heating water pipe 82.

The hot water supply unit H may include a water and refrigerant heat exchanger refrigerant control valve 86 that controls the flow of refrigerant, so that the refrigerant that has passed through the hot water supply heat exchanger 4 passes through or bypasses the water and refrigerant heat exchanger 72. The water and refrigerant heat exchanger 72 may be directly connected to the hot water supply outflow path 54 to allow refrigerant that has passed through the hot water supply heat exchanger 4 to be always used for floor heating, or may be provided with the water and refrigerant heat exchanger refrigerant control valve 86 to allow a user to select the floor heating operation.

The water and refrigerant heat exchanger refrigerant control valve 86 may be a floor heating valve that allows refrigerant to flow to the water and refrigerant heat exchanger 72 at a time point and/or during a time when the user or the like selects floor heating.

When the operation of the heat pump includes the floor heating operation, the water and refrigerant heat exchanger refrigerant control valve 86 may control the flow direction of refrigerant so that the refrigerant flows to the water and refrigerant heat exchanger 72, whereas, when the operation of the heat pump does not include the floor heating operation, the water and refrigerant heat exchanger refrigerant control valve 86 may control the flow direction of refrigerant so that the refrigerant bypasses the water and refrigerant heat exchanger 72.

The water and refrigerant heat exchanger refrigerant control valve 86 may be operated such that refrigerant flows to the water and refrigerant heat exchanger 72 when the floor heating operation is performed, when the floor heating operation and the hot water supply operation are simultaneously performed, or when the floor heating operation, the hot water supply operation, and the air conditioning operation are simultaneously performed.

The water and refrigerant heat exchanger refrigerant control valve 86 may be configured as a 3-way valve installed on the hot water supply flow path 50, namely, the hot water supply outflow path 54 to select a refrigerant outflow direction.

When the water and refrigerant heat exchanger refrigerant control valve 86 is a 3-way valve, an inlet port and a first outlet port thereof may be connected to the hot water supply outflow path 54 and a second outlet port thereof may be connected to the heating inflow path 74.

Alternatively, the water and refrigerant heat exchanger refrigerant control valve 86 may include a first valve installed on the heating inflow path 74 to be opened when the floor heating operation is performed and be closed when the floor heating operation is not performed, and a second valve installed on the hot water supply outflow path 54 to be closed when the floor heating operation is performed and be opened when the floor heating operation is not performed.

The heat exchanger bypass flow path 8 may be disposed such that refrigerant that has passed through the hot water supply heat exchanger 4 is guided between the outdoor heat exchanger 14 and the indoor heat exchanger 18, so as to allow the refrigerant that has passed through the hot water supply heat exchanger 4 to flow to one of the outdoor heat exchanger 14 and the indoor heat exchanger 18.

One end of the heat exchanger bypass flow path 8 may be connected to the hot water supply flow path 50 and another (or opposite) end thereof may be connected between the indoor expander 17 and the outdoor expander 16. As the one end of the heat exchanger bypass flow path 8 is connected to the hot water supply outflow path 54 of the hot water supply flow path 50 and the another end thereof is connected to the expander connection pipe 36, refrigerant of the hot water supply outflow path 54 may be guided between the indoor expander 17 and the outdoor expander 16.

Refrigerant flowing in the heat exchanger bypass flow path 8 may be expanded in the indoor expander 17 and be evaporated in the indoor heat exchanger 18, and then be recovered to the compressor 12, or may be expanded in the outdoor expander 16 and be evaporated in the outdoor heat exchanger 14, and then be recovered to the compressor 12. That is, when the refrigerant is guided between the indoor expander 17 and the outdoor expander 16 through the heat exchanger bypass flow path 8, the expansion process and the evaporation process only occur in the refrigeration cycle circuit 2 without the condensation process, thereby increasing the amount of heat transfer between the hot water supply heat exchanger 4 and the water and refrigerant heat exchanger 72, and improving the efficiency of hot water supply and floor heating.

An auxiliary refrigerant control valve 10 may control the flow direction of refrigerant that has passed through the hot water supply heat exchanger 4, so that the refrigerant that has passed through the hot water supply heat exchanger 4 passes through or bypasses the heat exchanger bypass flow path 8.

The auxiliary refrigerant control valve 10 may be configured as a single 3-way valve installed on the hot water supply outflow path 54 to select a refrigerant outflow direction. For example, when the auxiliary refrigerant control valve 10 is a 3-way valve, an inlet port and a first outlet port thereof may be connected to the hot water supply outflow path 54, and a second outlet port thereof may be connected to the heat exchanger bypass flow path 8.

FIGS. 3 to 7C are views for explaining a hot water supply tank according to various embodiments of the present disclosure.

In the following, when describing the hot water supply tank 56, a direction parallel to the width direction of the hot water supply tank 56 may be referred to as the +x-axis direction or the −x-axis direction, a direction parallel to the height direction of the hot water supply tank 56 may be referred to as the +y-axis direction, the −y-axis direction, the up direction, or the down direction, and a direction parallel to the length direction of the hot water supply tank 56 may be referred to as the +z-axis direction or the −z-axis direction. In addition, a direction parallel to the height direction of the hot water supply tank 56 may be referred to as the vertical direction or the up-and-down direction, and a direction perpendicular to the height direction of the hot water supply tank 56 may be referred to as the horizontal direction or the left-and-right direction.

Figure 3:
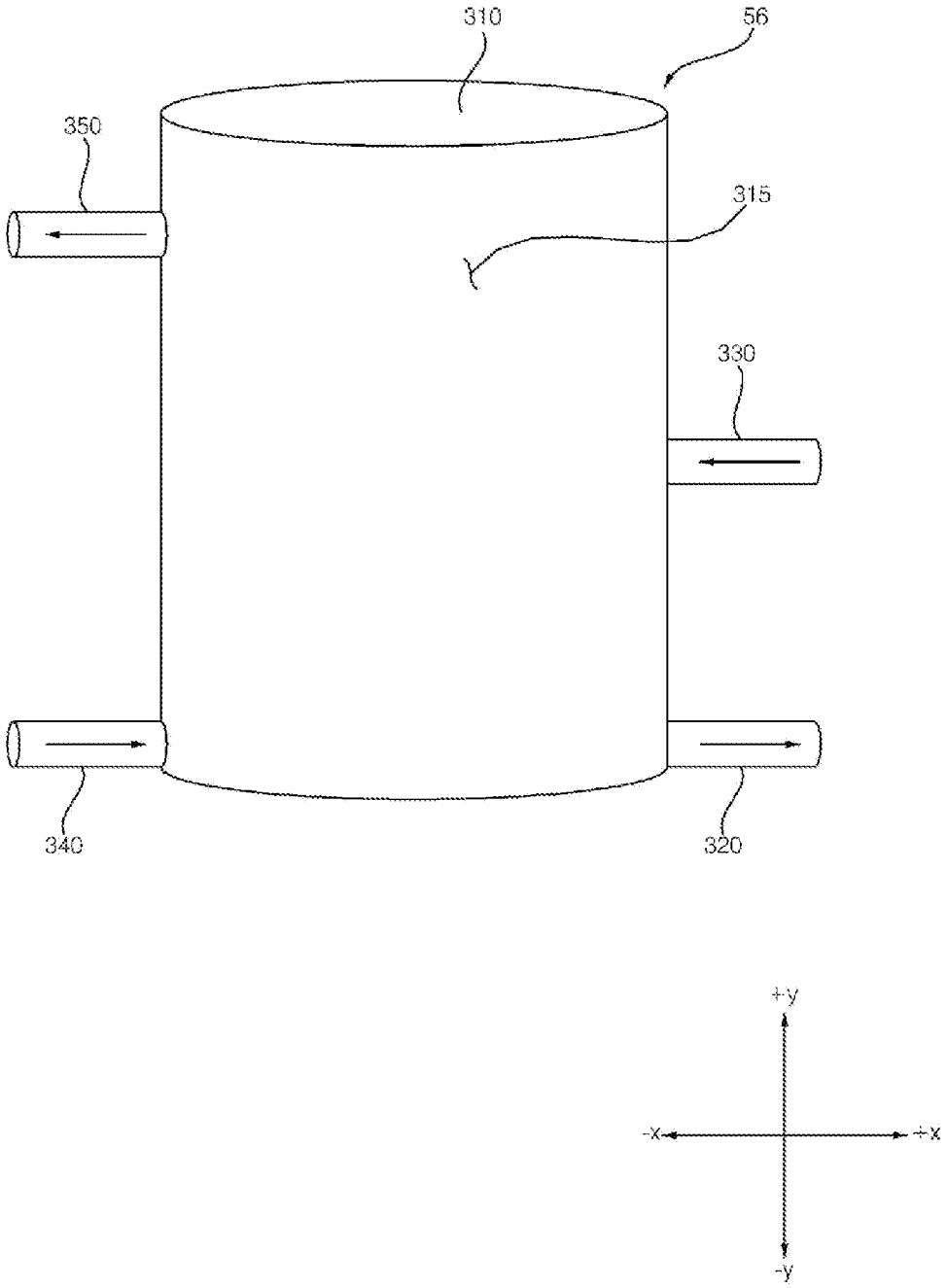
FIGS. 3 to 7C are views for explaining a hot water supply tank according to various embodiments of the present disclosure.

Referring to FIG. 3, the hot water supply tank 56 may include a storage part 310, an internal water outlet pipe 320 connected to the hot water pipe 58, an internal water inlet (or supply) pipe 330, an external water inlet pipe 340 connected to the water inlet 62, and/or an external water outlet pipe 350 connected to the water outlet 64.

In this drawing, the internal water outlet pipe 320, the internal water inlet pipe 330, the external water inlet pipe 340, and the external water outlet pipe 350 have a cylindrical shape elongated in a direction parallel to the width direction of the hot water supply tank 56, but the present disclosure is not limited thereto.

At least part of the components included in the hot water supply tank 56 may be made of stainless steel.

As anticorrosive treatment is applied to the inside of the storage part 310, the internal water outlet pipe 320, the internal water inlet pipe 330, the external water inlet pipe 340 and/or the external water outlet pipe 350, rust prevention on the surface may be achieved.

The storage part 310 may store water therein. Water introduced through the internal water inlet pipe 330 and/or the external water inlet pipe 340 may be stored in an inner space 315 of the storage part 310. A component defining the exterior of the storage part 310 may be referred to as a housing.

The internal water outlet pipe 320 may be connected to or communicate with the storage part 310 and the hot water pipe 58.

The internal water outlet pipe 320 may be disposed adjacent to a lower end of the storage part 310. When the internal water outlet pipe 320 is disposed adjacent to the lower end of the storage part 310, relatively low-temperature water stored in the storage part 310 may be discharged to an outside of the hot water supply tank 56 through the internal water outlet pipe 320.

When the hot water supply pump 60 provided on the hot water pipe 58 operates, at least part of water stored in the storage part 310 may pass through the internal water outlet pipe 320 to flow to the hot water supply heat exchanger 4.

The water that has flown into the hot water supply heat exchanger 4 through the internal water outlet pipe 320 may be heated by heat exchange with refrigerant in the hot water supply heat exchanger 4.

The internal water inlet pipe 330 may be connected to or communicate with the storage part 310 and the hot water pipe 58. The internal water inlet pipe 330 may be disposed above the internal water outlet pipe 320.

Water heated in the hot water supply heat exchanger 4 may be introduced into the storage part 310 after passing through the hot water pipe 58 and the internal water inlet pipe 330.

The external water inlet pipe 340 may be connected to or communicate with the storage part 310 and the water inlet 62.

The external water inlet pipe 340 may be disposed adjacent to a lower end of the storage part 310. When the external water inlet pipe 340 is disposed adjacent to the lower end of the storage part 310, relatively low-temperature water supplied from the outside may be introduced into a lower side of the storage part 310 through the water inlet 62.

The external water outlet pipe 350 may be connected to or communicate with the storage part 310 and the water outlet 64. In hot water supply mode in which hot water is used by a user, at least part of water stored in the storage part 310 may flow through the external water outlet pipe 350 and the water outlet 64.

The external water outlet pipe 350 may be disposed above the external water inlet pipe 340. The external water outlet pipe 350 may be disposed adjacent to an upper end of the storage part 310. When the external water outlet pipe 350 is disposed adjacent to the upper end of the storage part 310, relatively high-temperature water stored in the storage part 310 may be discharged to the outside of the hot water supply tank 56 through the external water outlet pipe 350.

Figure 4A:
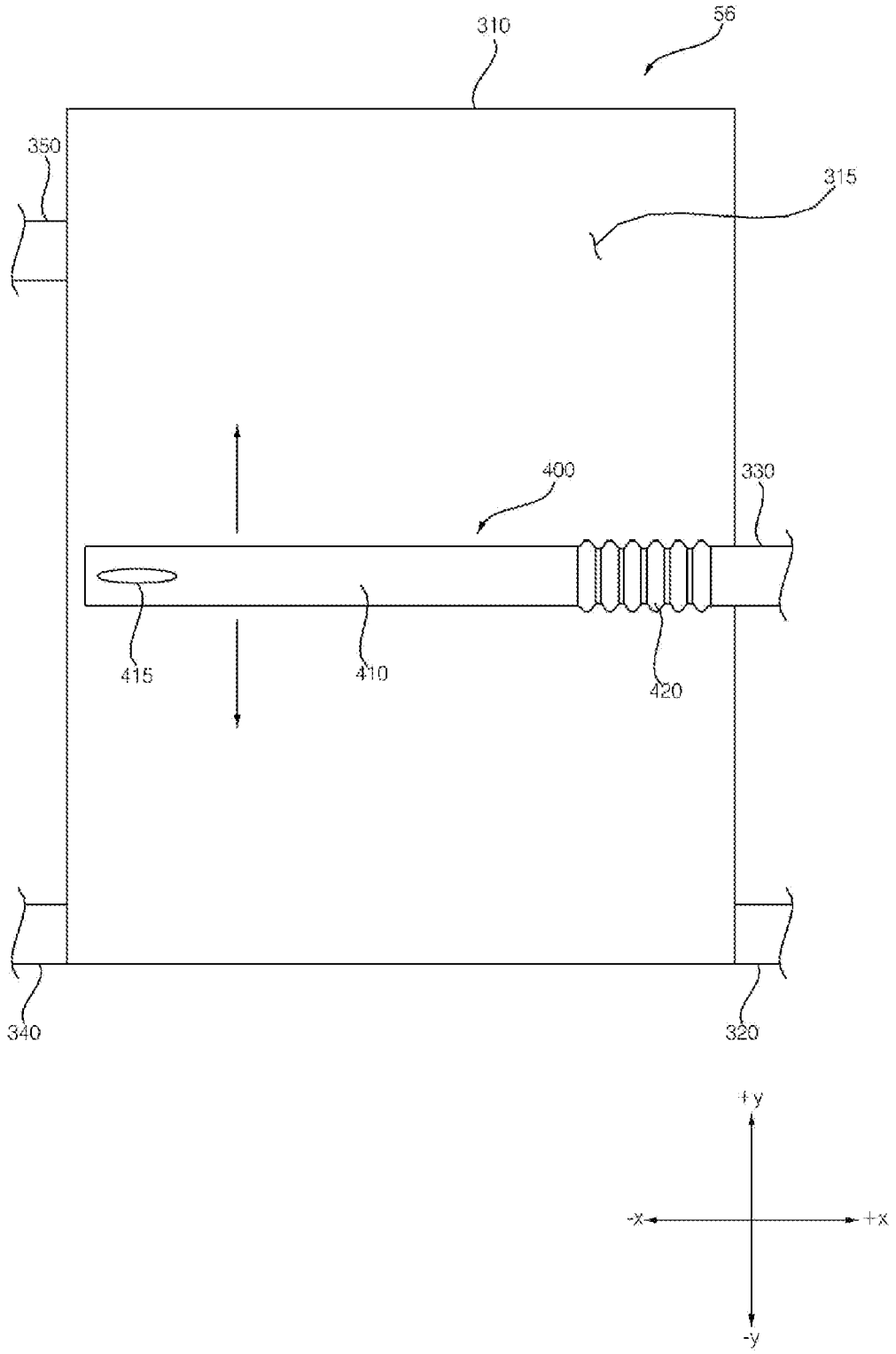
Figure 4B:
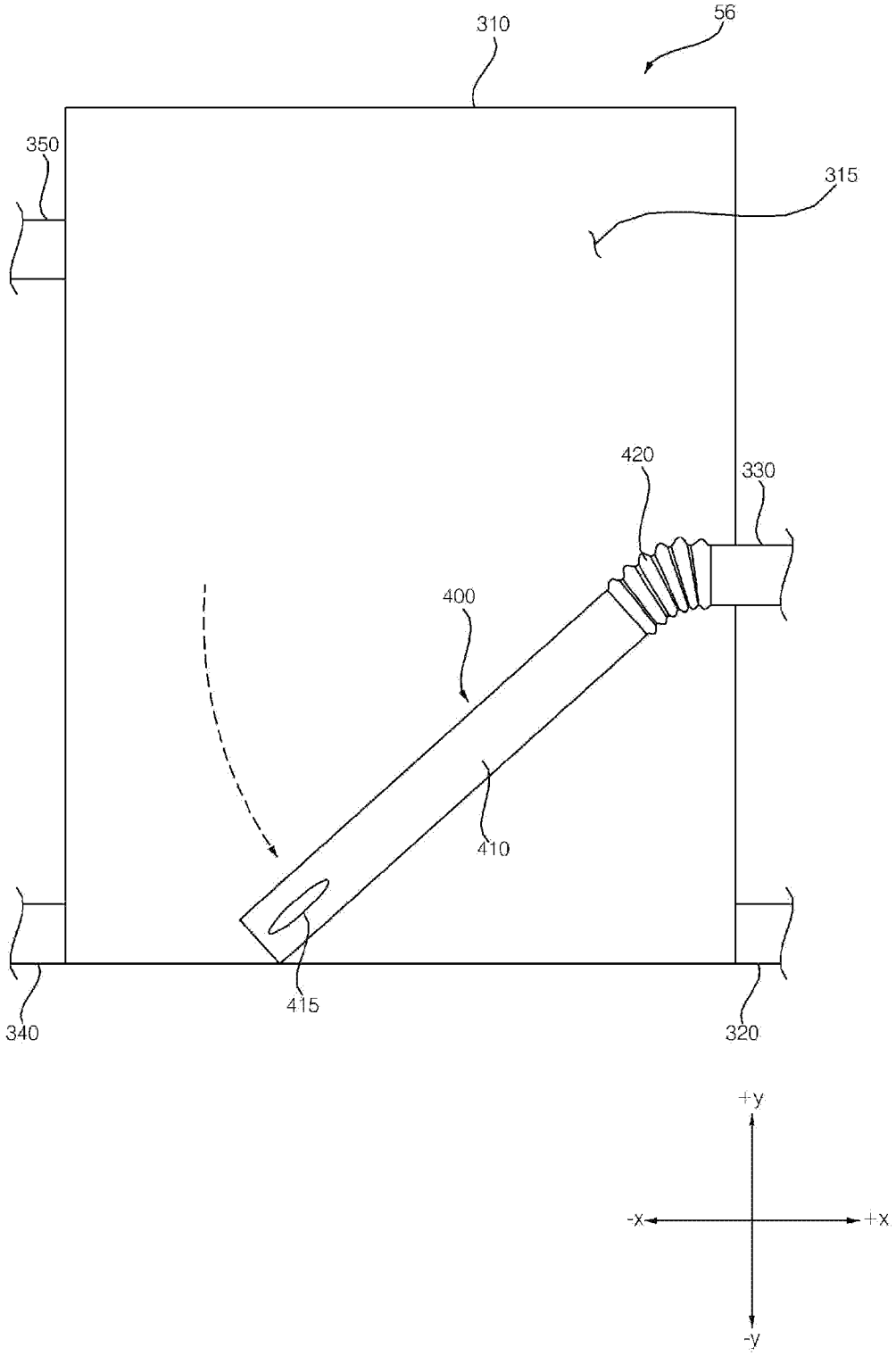
Figure 4C:
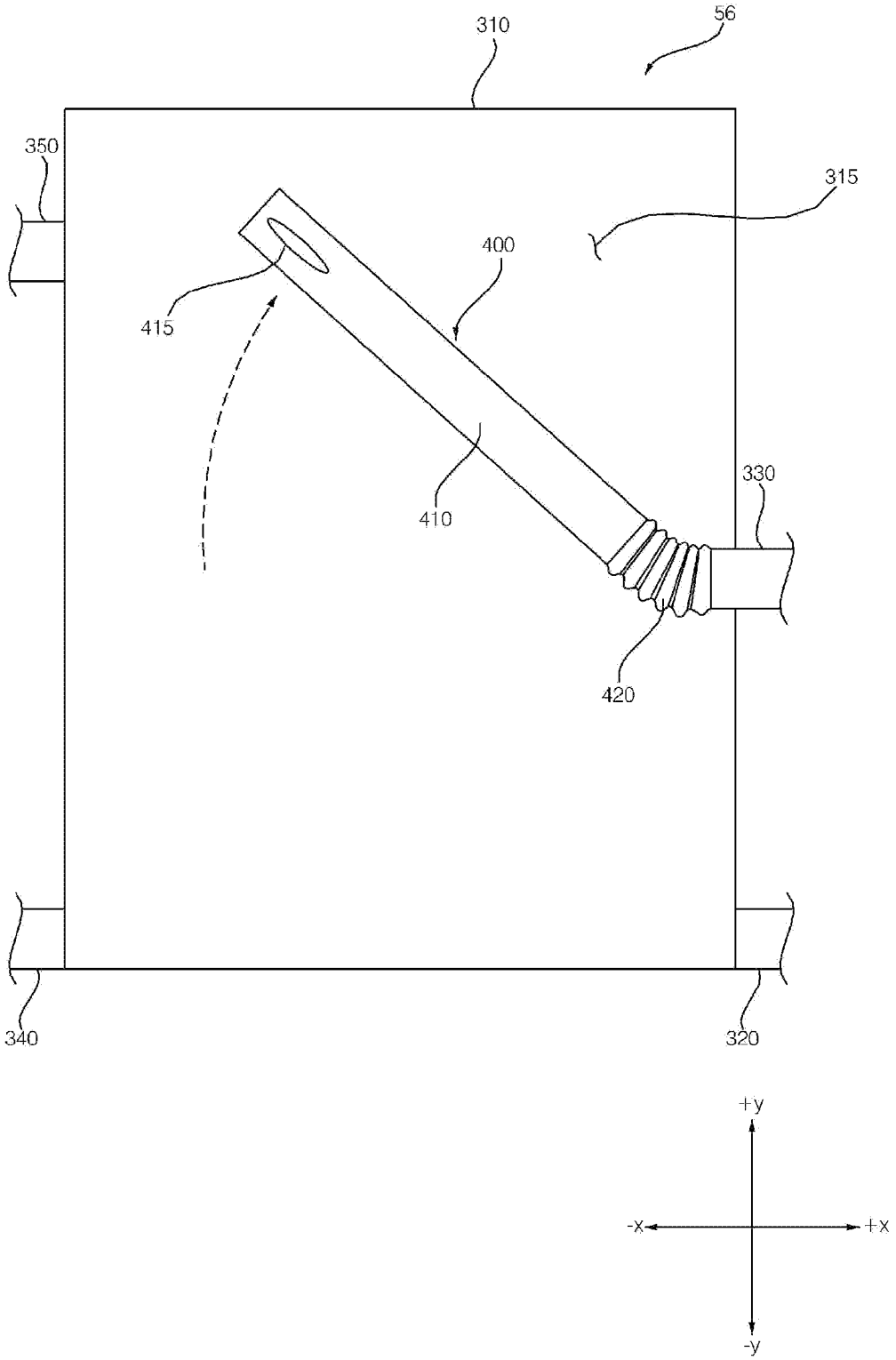

Referring to FIGS. 4A to 4C, a vertical cross-sectional view of the hot water supply tank 56 according to an embodiment of the present disclosure is illustrated.

The hot water supply tank 56 may include an internal pipe 400 disposed in the inner space 315 of the storage part 310.

The internal pipe 400 may be connected to or communicate with the internal water inlet pipe 330. The internal pipe 400 may be connected to or communicate with the internal water inlet pipe 330 at a middle or intermediate portion of the height of the storage part 310 with respect to the vertical direction.

The internal pipe 400 may include a discharge pipe 410 and/or a connection pipe 420.

The discharge pipe 410 may be elongated in one direction. For example, the discharge pipe 410 may have a cylindrical shape elongated in a direction parallel to the width direction of the hot water supply tank 56.

One end of the discharge pipe 410 may be connected to the connection pipe 420. At least one pipe through-hole 415 may be provided at another (or opposite) end of the discharge pipe 410. An inside of the discharge pipe 410 may be in communication with the inner space 315 of the storage part 310 through the pipe through-hole 415.

The pipe through-hole 415 may be formed at a lateral portion of the another end of the discharge pipe 410 toward the horizontal direction of the hot water supply tank 56. For example, water discharged from the inside of the discharge pipe 410 to the inner space 315 of the storage part 310 through the pipe through-hole 415 may flow in the horizontal direction.

The connection pipe 420 may be connected to or communicate with the discharge pipe 410 and the internal water inlet pipe 330. The connection pipe 420 may extend long in a direction parallel to the width direction of the hot water supply tank 56.

At least a portion of the connection pipe 420 may be flexible. At least a portion of the connection pipe 420 may be formed in a corrugated shape along an extension direction. The corrugation of the connection pipe 420 may include a plurality of recessed troughs and protruding crests to allow the connection pipe 420 to be bent multiple times.

A length L2 of the internal pipe 400 in a direction parallel to the width direction of the hot water supply tank 56 may be less than a diameter L1 of the hot water supply tank 56. For example, the length L2 of the internal pipe 400 may be greater than a radius L1/2 of the hot water supply tank 56 and less than the diameter L1 of the hot water supply tank 56. Here, the length L2 of the internal pipe 400 may be a length of the internal pipe 400 when a length of the connection pipe 420 is maximum in the extension direction.

The discharge pipe 410 and/or the connection pipe 420 may be made of a material having a specific gravity equal/similar to a specific gravity of water. For example, the specific gravity of the discharge pipe 410 may correspond to the specific gravity (e.g., 0.9991 g/mL) of water at a predetermined temperature (e.g., 15° C.). For example, the specific gravity of the discharge pipe 410 may be greater than the specific gravity of water introduced through the internal water inlet pipe 330 and less than the specific gravity of water introduced through the external water inlet pipe 340.

A position of the pipe through-hole 415 formed at the another end of the discharge pipe 410 may be changed in the inner space 315 of the storage part 310. The position of the pipe through-hole 415 may be changed to top (up), bottom (down), left, or right by the corrugation formed on the connection pipe 420.

The position of the pipe through-hole 415 may be changed according to the temperature of water introduced through the internal water inlet pipe 330.

For example, the temperature of water in the internal pipe 400 may be maintained while no water is being drawn through the internal water inlet pipe 330. In this case, the position of the pipe through-hole 415 may be maintained in the inner space 315 of the storage part 310.

For example, when the temperature of water introduced through the internal water inlet pipe 330 is equal to the temperature of water in the internal pipe 400, a total specific gravity of the discharge pipe 410 may remain unchanged while the internal pipe 400 is filled with the water being drawn through the internal water inlet pipe 330. In this case, the position of the pipe through-hole 415 may be maintained in the inner space 315 of the storage part 310.

For example, when the temperature of water introduced through the internal water inlet pipe 330 is lower than the temperature of water in the internal pipe 400, a total specific gravity of the discharge pipe 410 may gradually increase. Here, as the total specific gravity of the discharge pipe 410 increases, the position of the pipe through-hole 415 may be changed toward the bottom of the storage part 310 as shown in FIG. 4B.

For example, when the temperature of water introduced through the internal water inlet pipe 330 is higher than the temperature of water in the internal pipe 400, a total specific gravity of the discharge pipe 410 may gradually decrease. Here, as the total specific gravity of the discharge pipe 410 decreases, the position of the pipe through-hole 415 may be changed toward the top of the storage part 310 as shown in FIG. 4C.

As described above, when the position of the pipe through-hole 415 is changed according to the temperature of water introduced through the internal water inlet pipe 330, the temperature of water discharged from the discharge pipe 40 to the inner space 315 through the pipe though-hole and the temperature of water corresponding to the position of the pipe through-hole 415 may be equal/similar to each other. Therefore, the collapse of thermal stratification of water stored in the inner space 315 of the storage part 310 may be minimized.

Figure 5A:
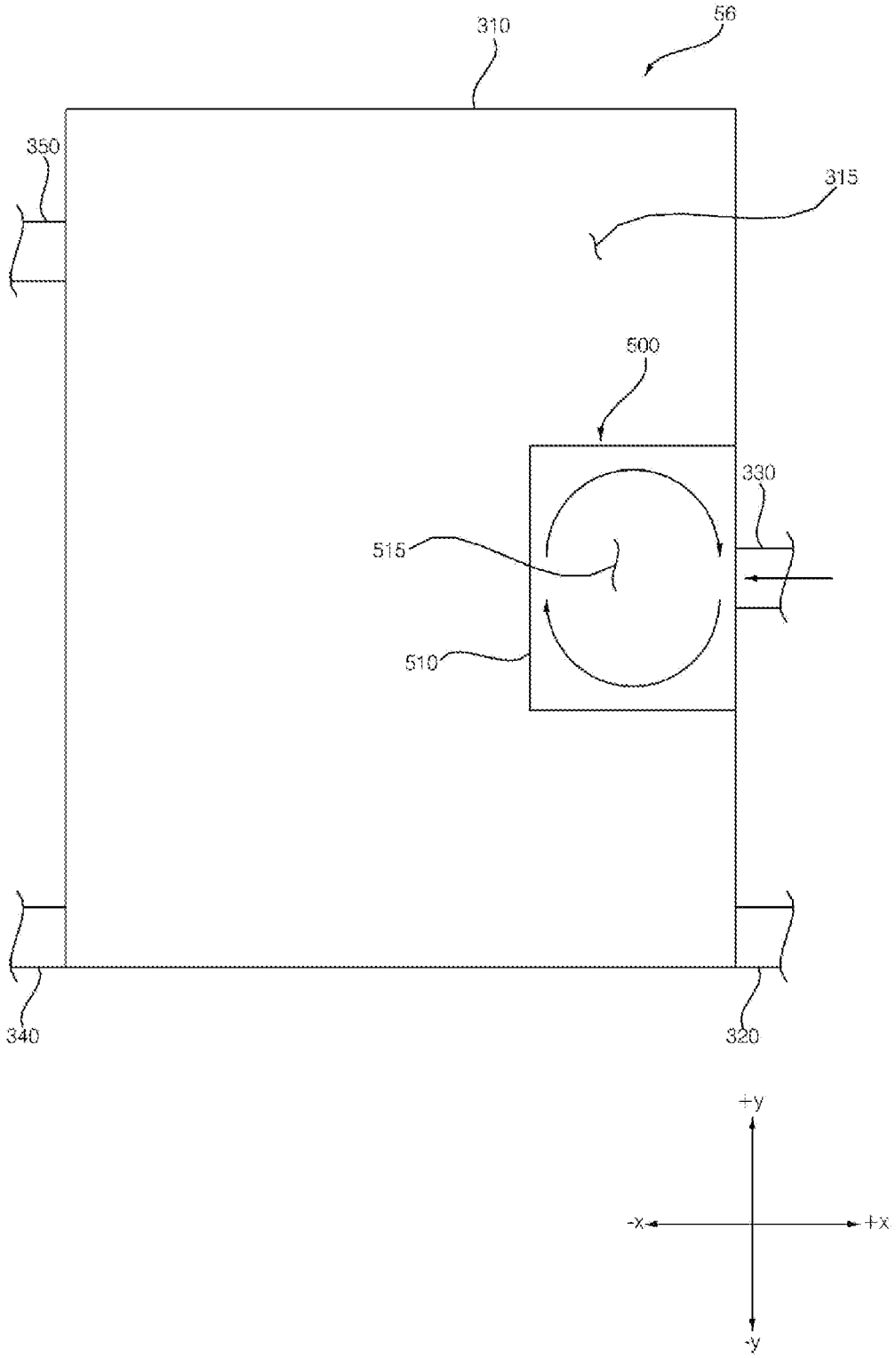
Figure 5B:
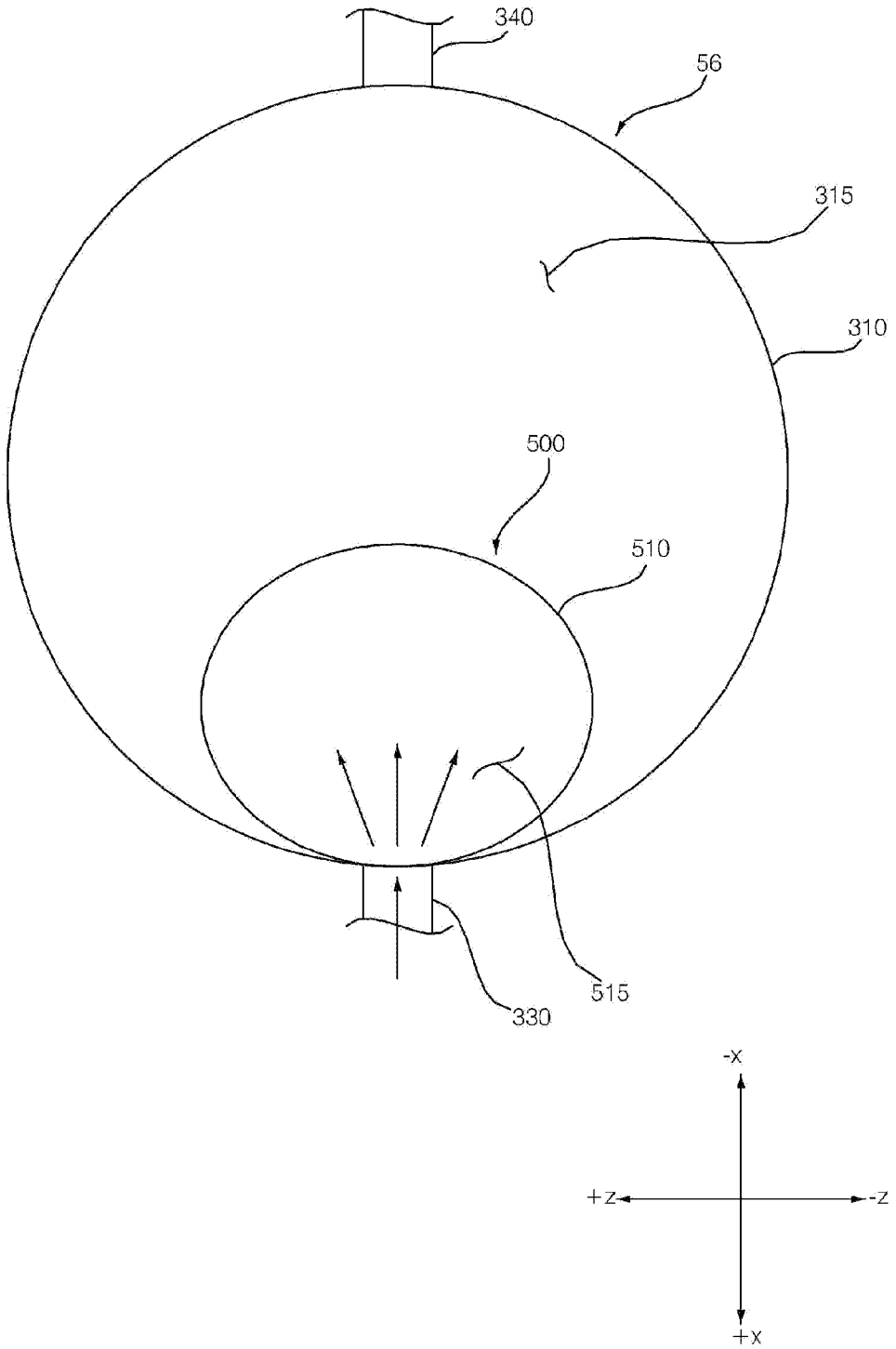
Figure 5C:
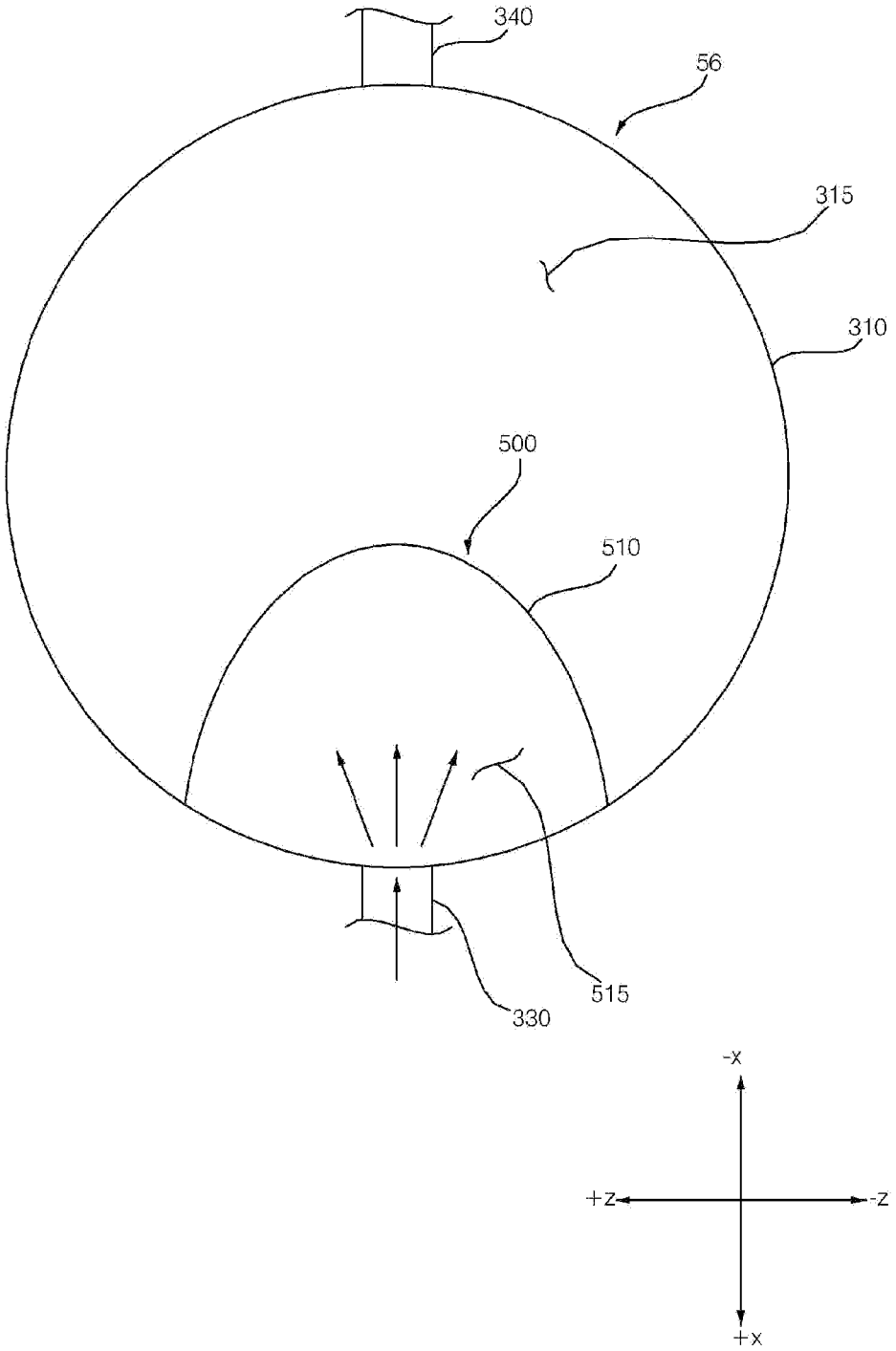

Referring to FIGS. 5A to 5C, a vertical cross-sectional view and a horizontal cross-sectional view of the hot water supply tank 56 according to an embodiment of the present disclosure are illustrated.

The hot water supply tank 56 according to this embodiment may further include a buffer 500 disposed in the storage part 310.

The buffer 500 may include a lateral wall 510 elongated in the vertical direction of the hot water supply tank 56. A space surrounded by an inner circumferential surface of the lateral wall 510 may be referred to as a buffer space 515.

In one embodiment, the buffer space 515 may be surrounded only by the inner circumferential surface of the lateral wall 510 as shown in FIG. 5B. In one embodiment, the buffer space 515 may be surrounded by the inner circumferential surface of the lateral wall 510 and a portion of an inner circumferential surface of the storage part 310 as shown in FIG. 5C.

The inner space 315 of the storage part 310 and the buffer space 515 of the buffer 500 may be disconnected from each other in the horizontal direction by the lateral wall 510. The inner space 315 of the storage part 310 and the buffer space 515 of the buffer 500 may be connected to or communicate with each other in the vertical direction.

The internal water inlet pipe 330 and the buffer space 515 may be in communication with each other. Water supplied from the hot water supply heat exchanger 4 may be introduced into the buffer space 515 through the internal water inlet pipe 330.

The buffer 500 may be formed in the storage part 310 in a predetermined position that allows water supplied through the internal water inlet pipe 330 to be discharged toward a center of the buffer space 515.

When water is introduced into the buffer space 515 through the internal water inlet pipe 330, at least part of water stored in the buffer space 515 may flow to the inner space 315 of the storage part 310. For example, when water is introduced into the buffer space 515 through the internal water inlet pipe 330, water at an upper part of the buffer space 515 may flow to the +y-axis direction, and water at a lower part of the buffer space 515 may flow to the −y axis direction.

The phenomenon of convection may occur in the buffer space 515 due to a temperature difference between water introduced into the buffer space 515 through the internal water inlet pipe 330 and water stored in the buffer space 515. Here, as the inner space 315 of the storage part 310 and the buffer space 515 of the buffer 500 are disconnected from each other in the horizontal direction by the lateral wall 510, convection in the inner space 315 may be minimized.

Meanwhile, after water introduced into the buffer space 515 and water stored in the buffer space 515 are mixed with each other, according to the temperature of water mixed in the buffer space 515, the water may flow between the buffer space 515 and the inner space 315.

For example, when the temperature of water mixed in the buffer space 515 is higher than the temperature of water in the inner space 315 adjacent to the upper part of the buffer space 515, at least part of the water mixed in the buffer space 515 may flow to the +y-axis direction. Here, water at the upper part of the buffer space 515 in the inner space 315 may be first mixed with water discharged from the buffer space 515.

For example, when the temperature of water mixed in the buffer space 515 is lower than the temperature of water in the inner space 315 adjacent to the lower part of the buffer space 515, at least part of the water mixed in the buffer space 515 may flow to the −y-axis direction. Here, water at the lower part of the buffer space 515 in the inner space 315 may be first mixed with water discharged from the buffer space 515.

Figure 6A:
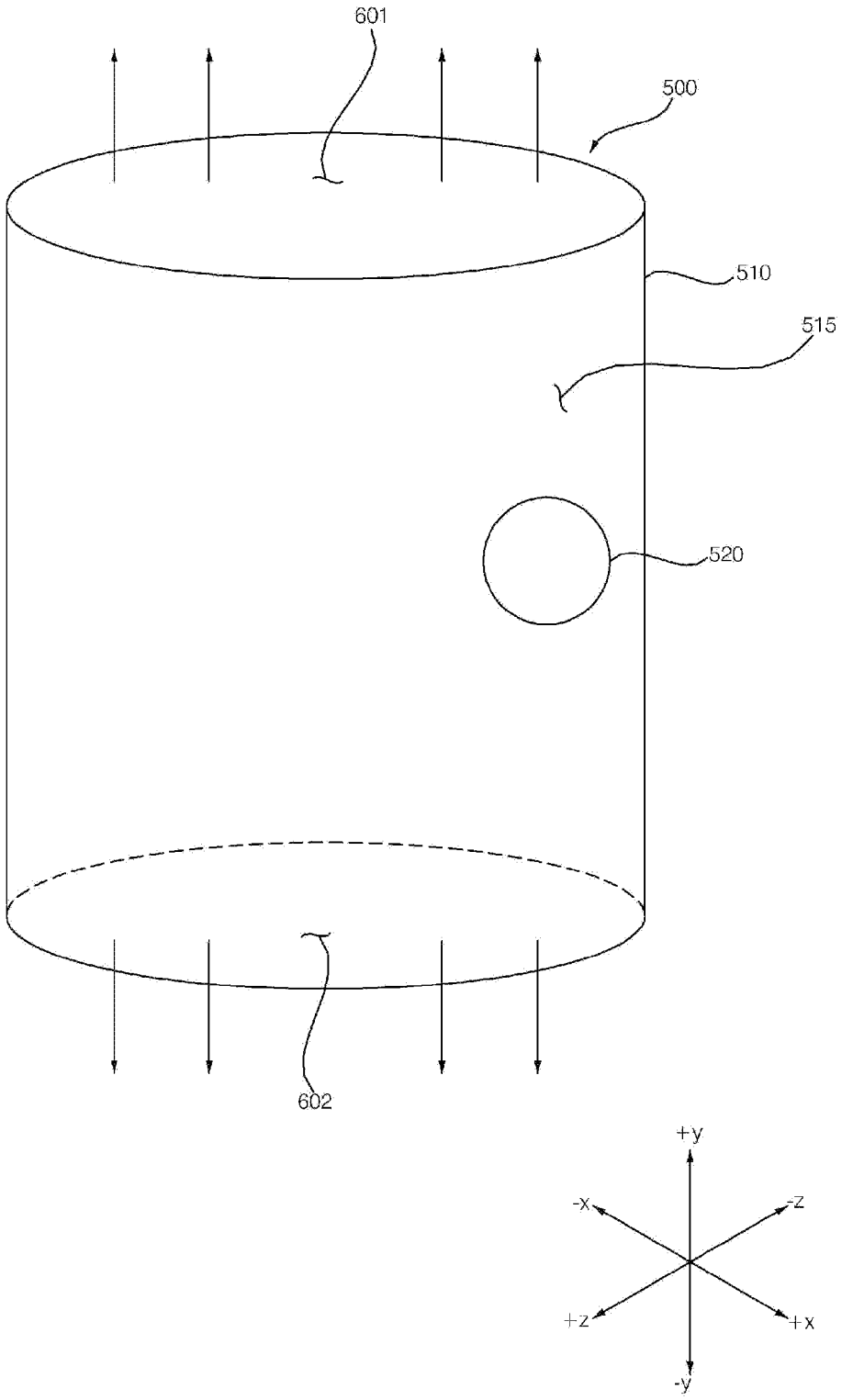
Figure 6B:
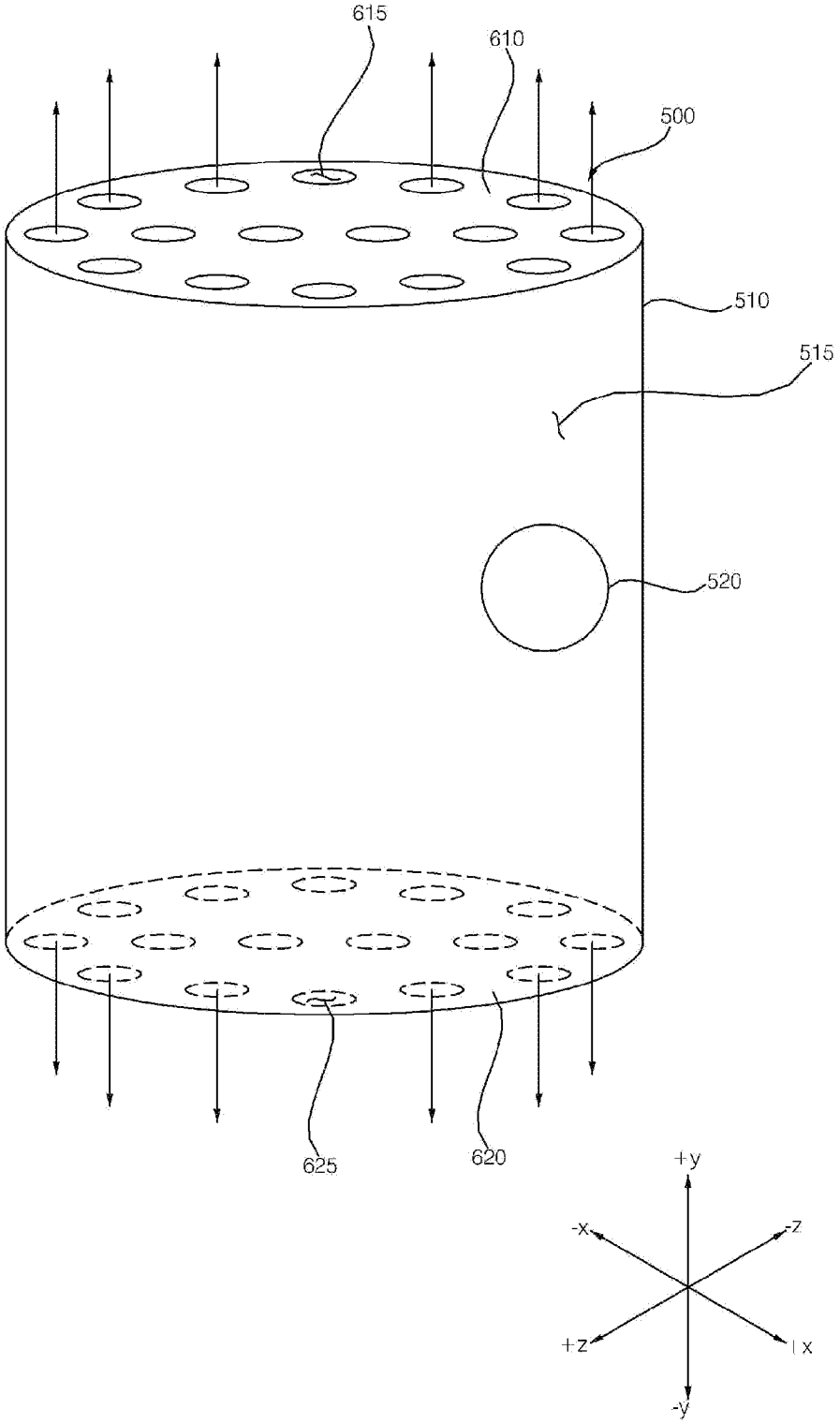

Referring to FIGS. 6A and 6B, a lateral wall through-hole 520 formed through the lateral wall 510 may be defined in one region of the lateral wall 510.

The lateral wall through-hole 520 may be connected to the internal water inlet pipe 330. A shape of the lateral wall through-hole 520 may correspond to a shape of a vertical cross section of the internal water inlet pipe 330. Water flowing in the internal water inlet pipe 330 may be introduced into the buffer space 515 through the lateral wall through-hole 520.

The lateral wall through-hole 520 may be formed at an intermediate portion of the lateral wall 510 with respect to the vertical direction. Here, water supplied through the lateral wall through-hole 520 may be discharged toward the center of the buffer space 515.

In one embodiment, as shown in FIG. 6A, the buffer space 515 surrounded by the lateral wall 510 may be open at the top and the bottom.

In another embodiment, as shown in FIG. 6B, the buffer 500 may further include a cover (610, 620) disposed at the top/or the bottom of the buffer space 515 surrounded by the lateral wall 510. In this drawing, it is illustrated that the buffer 500 includes the cover 610, 620 when the buffer space 515 is surrounded only by the inner circumferential surface of the lateral wall 510, but the present disclosure is not limited thereto. The buffer 500 may also include the cover 610, 620 even when the buffer space 515 is surrounded by the inner circumferential surface of the lateral wall 510 and a portion of the inner circumferential surface of the storage part 310.

An upper cover 610 may be connected to an upper end portion of the lateral wall 510 to cover the top of the buffer space 515.

The lower cover 620 may be connected to a lower end portion of the lateral wall 520 to cover the bottom of the buffer space 515.

The upper cover 610 may have at least one upper through-hole 615 formed therethrough. Water may flow between the top of the buffer space 515 and the inner space 315 through the upper through-hole 615. The total sum of the area of the at least one upper through-hole 615 formed at the upper cover 610 may be greater than or equal to the area of the lateral wall through-hole 520.

The lower cover 620 may have at least one lower through-hole 625 formed therethrough, and water may flow between the bottom of the buffer space 515 and the inner space 315 through the upper through-hole 615. The total sum of the area of the at least one lower through-hole 625 formed at the lower cover 620 may be greater than or equal to the area of the lateral wall through-hole 520.

As described above, when the buffer 500 is disposed in the storage part 310, a change in temperature of water stored in the storage part 310, due to hot water supplied from the hot water supply unit H, may be minimized, thereby minimizing the collapse of thermal stratification of the water stored in the storage part 310.

In addition, when water is introduced into the buffer space 515 through the internal water inlet pipe 330, as the buffer 500 further includes the cover 610, 620, the phenomenon of convection in the inner space 315 may be further minimized, and the water may be mixed more slowly between the buffer space 515 and the inner space 315.

Figure 7A:
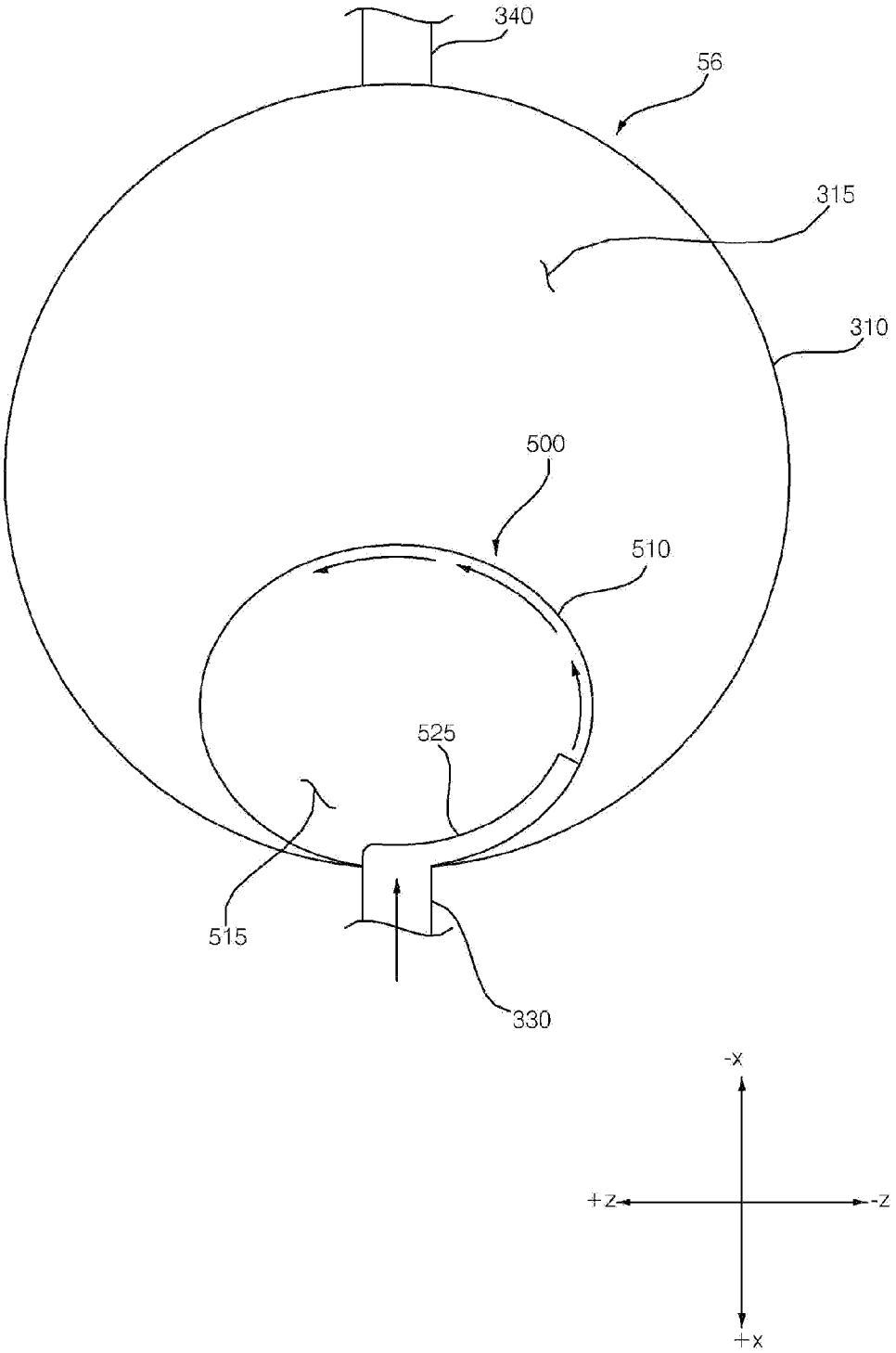
Figure 7B:
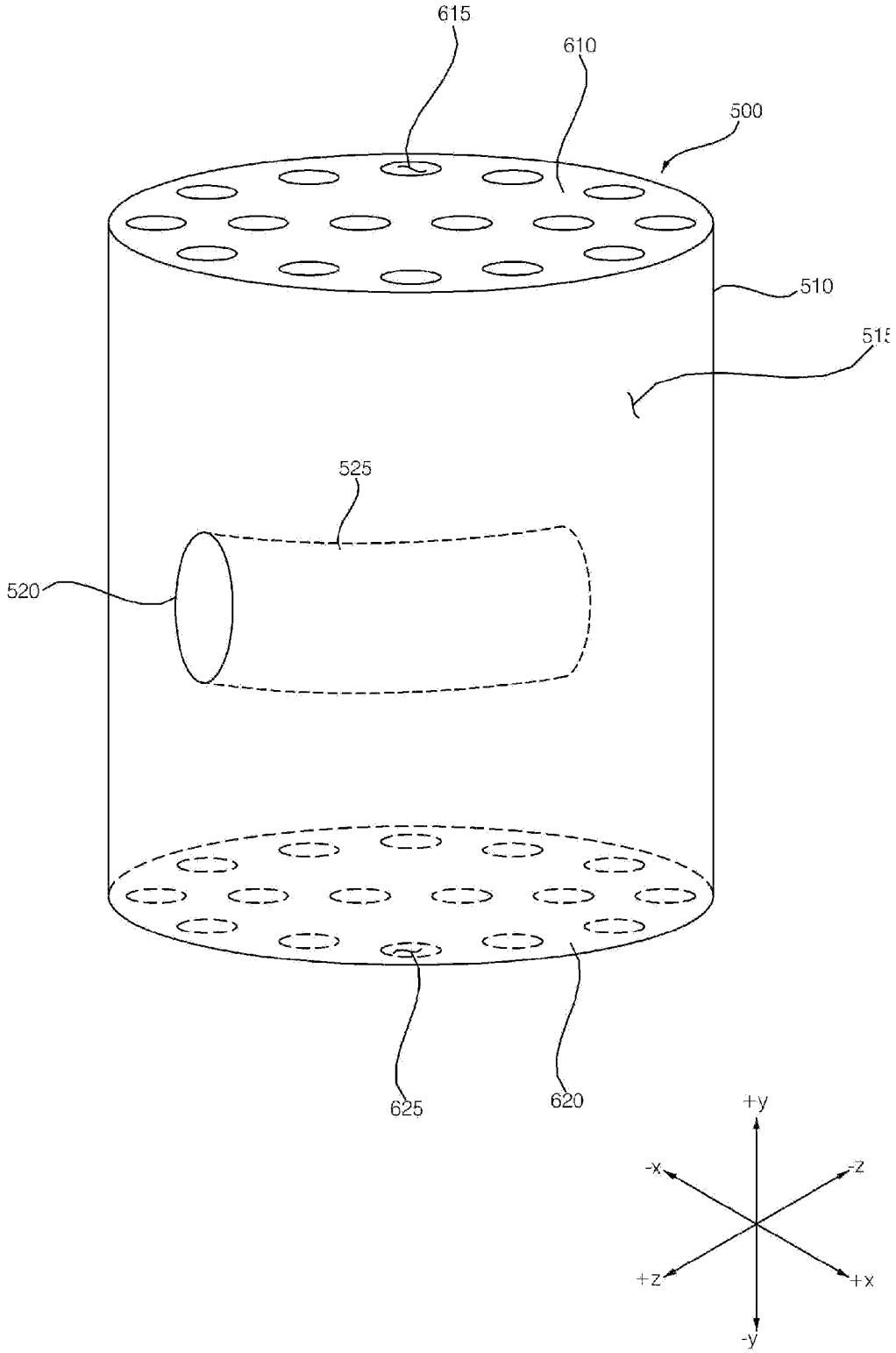
Figure 7C:
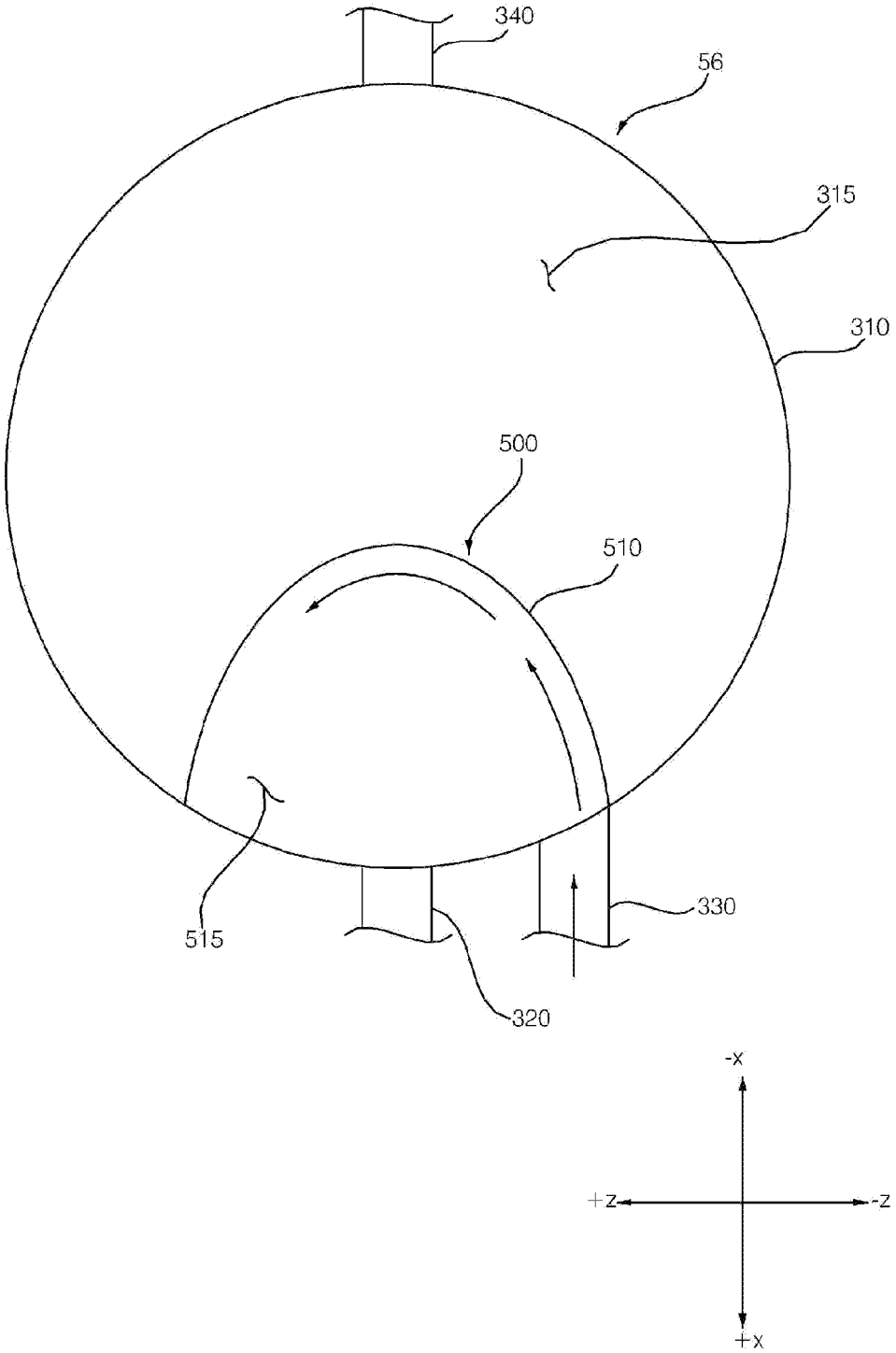

Referring to FIGS. 7A and 7B, the hot water supply tank 56 according to an embodiment of the present disclosure may further include a swirl induction pipe 525 connected to the lateral wall through-hole 520.

The swirl induction pipe 525 may extend along the inner circumferential surface of the lateral wall 510. The swirl induction pipe 525 may extend parallel to a horizontal direction of the lateral wall 510.

Water flowing through the internal water inlet pipe 330 and the lateral wall through-hole 520 may pass through the swirl induction pipe 525 and then be introduced into the buffer space 515.

When water is discharged toward the buffer space 515 after passing through the swirl induction pipe 525, a circular motion of water in one direction along the inner circumferential surface of the lateral wall 510, namely, the flow in the form of a swirl may occur in the buffer space 515.

Meanwhile, referring to FIG. 8, in the case of the hot water supply tank 56 according to an embodiment of the present disclosure, the internal water inlet pipe 330 may be formed in the buffer space 515 in a predetermined position that causes the flow in the form of a swirl.

When the internal water inlet pipe 330 is provided in the predetermined position, an extension direction of the internal water inlet pipe 300 may correspond to a tangential direction of the inner circumferential surface of the lateral wall 510. Here, water supplied through the internal water inlet pipe 330 may be discharged toward the tangential direction of the inner circumferential surface of the lateral wall 510, and may generate the flow in the form of a swirl in the buffer space 515.

As described above, when water introduced into the buffer space 515 flows along the inner circumferential surface of the lateral wall 510, due to the flow in the form of a swirl generated in the buffer space 515, the water introduced into the buffer space 515 may be better mixed with water stored in the buffer space 515 without colliding with the lateral wall 510.

The accompanying drawings are used to help easily understand the technical idea of the present disclosure and it should be understood that the idea of the present disclosure is not limited by the accompanying drawings. The idea of the present disclosure should be construed to extend to any alterations, equivalents, and substitutes besides the accompanying drawings.

Although preferred embodiments of the present disclosure have been shown and described herein, the present disclosure is not limited to the specific embodiments described above. It will be understood that various modifications and changes can be made by those skilled in the art without departing from the idea and scope of the present disclosure as defined by the appended claims. Therefore, it shall be considered that such modifications, changes, and equivalents thereof are all included within the scope of the present disclosure.

The invention claimed is:

1. A hot water supply tank comprising:

a storage part in which a fluid is stored;

an internal water outlet pipe through which the fluid flows from the storage part to a heat pump;

an internal water inlet pipe through which the fluid flows from the heat pump to the storage part; and an internal pipe disposed in the storage part, wherein the internal pipe comprises:

a connection pipe connected to the internal water inlet pipe and having at least a portion being flexible; and a discharge pipe having one end connected to the connection pipe and being elongated and non-flexible, wherein at least one pipe through-hole formed through the discharge pipe is defined at another end of the discharge pipe, wherein a maximum horizontal length of the internal pipe is equal to a sum of a maximum length of the connection pipe and a fixed length of the discharge pipe, and is less than a diameter of the storage part, wherein the maximum length of the connection pipe is less than the fixed length of the discharge pipe, and wherein a specific gravity of the discharge pipe corresponds to a specific gravity of the fluid at a predetermined temperature.

2. The hot water supply tank of claim 1, wherein the pipe through-hole is formed at a lateral portion of the another end of the discharge pipe facing a horizontal direction of the storage part.

3. The hot water supply tank of claim 1, wherein at least a portion of the connection pipe is bent multiple times along an extension direction to have a corrugated shape.

4. The hot water supply tank of claim 1, wherein the internal pipe is connected to the internal water inlet pipe at a portion corresponding to a middle of a vertical height of the storage part.

* * * * *